United States Patent [19]

Chiang

[11] Patent Number: 4,979,622

[45] Date of Patent: Dec. 25, 1990

[54] PORTABLE HULL SEPARATOR

[76] Inventor: Dick P. Chiang, 21551 Brookhurst St., Apt. 171, Huntington Beach, Calif. 92646

[21] Appl. No.: 228,108

[22] Filed: Aug. 4, 1988

[51] Int. Cl.[5] ..... B07B 9/00; B07B 4/02

[52] U.S. Cl. ..... 209/33; 209/135; 209/153; 209/154

[58] Field of Search ..... 209/20, 32, 33, 134, 209/135, 146, 147, 149, 153, 154

[56] References Cited

U.S. PATENT DOCUMENTS

| | | | |
|---|---|---|---|
| 507,488 | 10/1893 | Davidson | 209/33 |
| 764,478 | 7/1904 | Lewis | 209/145 |
| 775,965 | 11/1904 | Edison | 209/135 |
| 1,042,836 | 10/1912 | Stromberg | 209/135 |
| 1,052,616 | 2/1913 | Nordin | 209/135 X |
| 1,348,043 | 7/1920 | Parkinson | 209/135 |
| 1,420,593 | 6/1922 | Titchmarsh | 209/154 X |
| 2,210,103 | 8/1940 | Stoner | 209/135 X |
| 2,222,861 | 11/1940 | Stoner | 209/135 |
| 2,828,011 | 3/1958 | Whitby | 209/20 |
| 3,384,233 | 5/1968 | Bolles | 209/153 X |
| 3,441,134 | 4/1969 | Oetiker | 209/147 X |

FOREIGN PATENT DOCUMENTS

| | | | |
|---|---|---|---|
| 1584957 | 2/1981 | United Kingdom | 209/134 |

*Primary Examiner*—Margaret A. Focarino
*Assistant Examiner*—Edward M. Wacyra
*Attorney, Agent, or Firm*—Roy A. Ekstrand

[57] ABSTRACT

A portable hull separator includes a closed housing defining a pair of apertures which support removable drawers together with a plurality of air apertures. An air flow chamber within the housing is subjected to an air flow created by a motor driven fan. A seed bin within the housing is coupled to a descending air passage such that seed and hull material within the bin is caused to flow downwardly through the passage in which it is subjected to a transverse air flow. Adjustable gates are provided which alter the air flow characteristics and thereby the hull separation characteristics of the separator in accordance with an external adjustment.

7 Claims, 1 Drawing Sheet

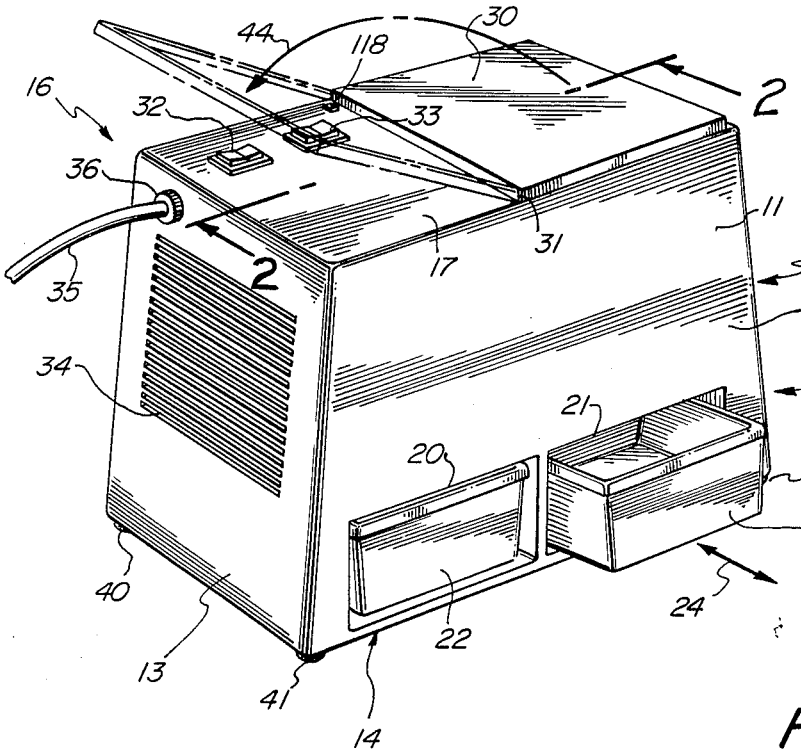
FIG. 1
FIG. 2
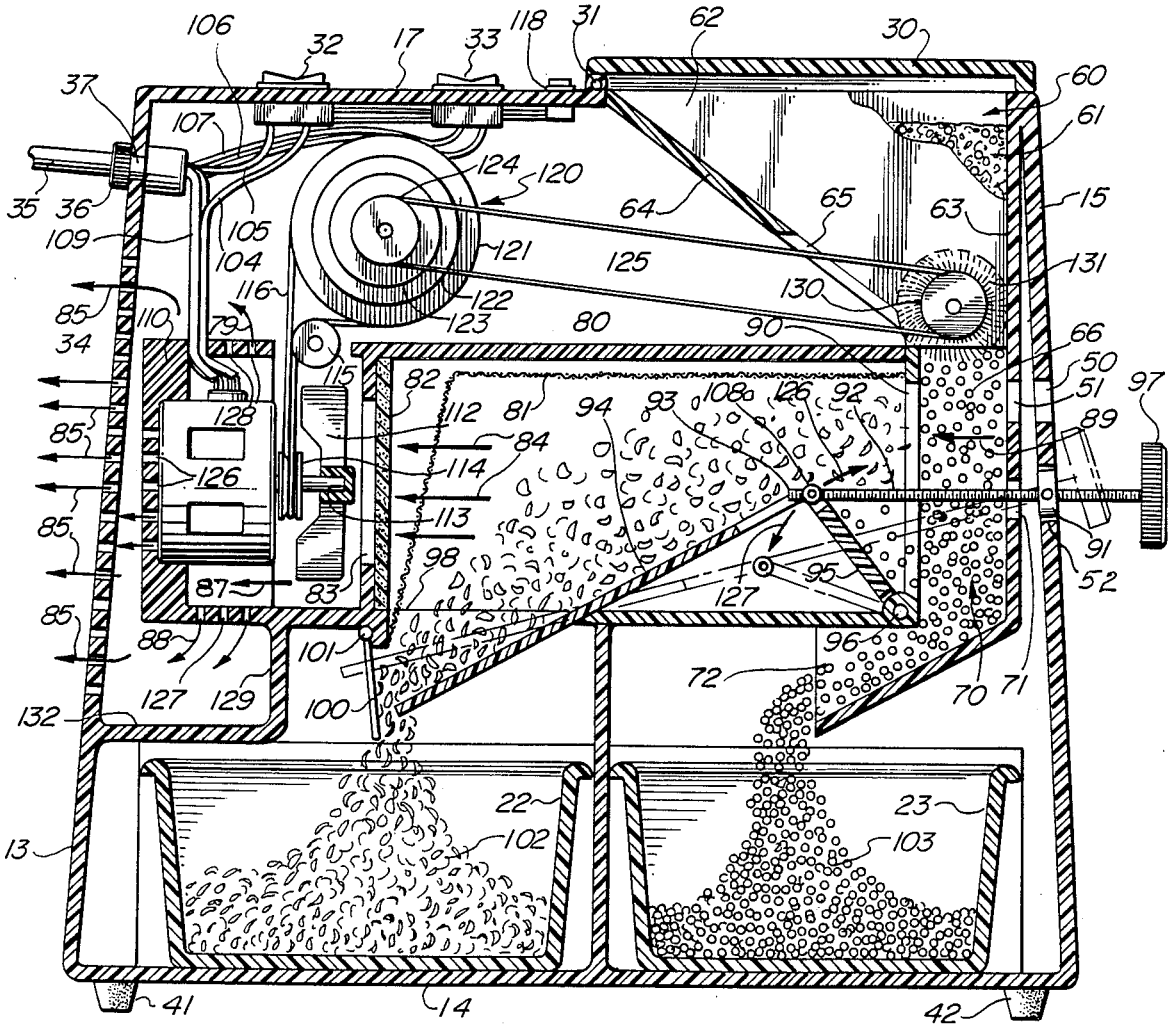

PORTABLE HULL SEPARATOR

FIELD OF THE INVENTION

This invention relates generally to the process of separating the lighter from grains and seed and particularly for such processes which utilize a flow of air for separation according to material weight.

BACKGROUND OF THE INVENTION

Through the years, many people have participated in maintaining various types of birds within their dwellings for purposes of amusement and pleasure. In the typical bird environment, a small cage is maintained within which the birds are secured and housed. Among the food preparations provided by bird keepers for their pet birds, the most common is a mixture of various seeds and small grains which form the staple of the pet birds.

In the majority of seeds and small grains used for bird seed mixture, a problem arises in the presence of the outer hull material of the seed separate from the seed itself. Since typically such bird seed mixtures are purchased in bulk and comprise a mixture of various sizes of seed, the presence of the undesired hull materials is an annoyance and source of difficulty for the bird keeper. The problem is exacerbated by the tendency of seed hulls to break off and separate during shipping and handling of the seed mixture. As a result, the typical seed mixture product obtained by the bird keeper is often undesirably mixed with empty hulls. Since small quantities of seed mixture are dispensed to the receptacles within the bird cage, the presence of excessive seed hulls within the mixture dilute the amount of nutritious seed mixture given to the pet birds at any given feeding.

A similar problem arises in the food industries which process, store and transport grain and other similar materials. To meet this need, a number of devices have been developed through the years which provide a separation of the hull materials from the remainder of the grain. In general, such mechanisms differ substantially in construction details and operational subtleties but typically make use of an air flow to achieve separation. The use of air flow to separate the heavier grains from the lighter hull materials is well known and originates in the ancient agricultural process in which quantities of grain and hull material were simply thrown into the air on windy days. The wind passing through the airborne mixture of grain and hull material carried the lighter hull material away but had little effect upon the heavier grain. Thus, the grain material, relatively free of the lighter hulls, accumulated on the ground while the hulls and other light materials were blown to a separate pile.

One example of such air separators is set forth in U.S. Pat. No. 2,828,011 issued to Whitby which sets forth a STRATIFIER AND AIR SEPARATOR in which a quantity of mixed particles of material are caused to be dropped through an area in which they are subjected to a cross flow of air. A plurality of collecting bins are supported beneath the material flow for collection of the material. The principle of operation relies upon the different weights of the particles to produce stratified downward flow of the materials and thereby separate them from each other.

U.S. Pat. No. 775,965 issued to Edison sets forth a DRY SEPARATOR in which a blower produces a flow of air through a large passage. The passage defines an upper aperture through which a quantity of to-be-separated material is introduced to the air flow. The bottom portion of the air passage includes a pair of collecting baffles spaced apart with one upstream of the other in the air flow. In operation, a granular material such as a mixture of free gold and loose gravel is dropped through the air flow and the heavier gold material accumulates in the upstream baffle while the lighter gravel accumulates in the downstream baffle.

U.S. Pat. No. 1,042,836 issued to Stromborg sets forth a SEPARATOR in which a large plenum is provided with an aperture and chute through which the to-be-separated material is introduced to the plenum. The plenum supports a plurality of directing baffle members as well as a plurality of collecting bins. The bins are arranged in a serial arrangement in the direction of air flow. A blower mechanism is coupled to the plenum and provides a flow of air through the plenum. In operation, the to-be-separated material is introduced to the plenum through the upper chute and is affected by the transverse air flow through the plenum in accordance with the baffle orientation. The heavier materials accumulate in the more upstream bins while the lighter materials are deflected and collected in the downstream bins.

U.S. Pat. No. 764,478 issued to Lewis sets forth a GRAIN SEPARATOR in which a quantity of material is accumulated in a hopper and poured through a bottom aperture to provide a downward flow of the material. A rotating paddle wheel is supported beneath the hopper and receives the downward flow of material. The rotating paddle wheel causes the heavier particles to be deflected or thrown a different distance than the lighter particles. In addition, a fan mechanism is provided to direct an air flow transversely across the material to assist in the separation process.

U.S. Pat. No. 3,384,233 issued to Bolles sets forth a PROCESS AND APPARATUS FOR DRY-CLEANING SUGAR CANE in which a quantity of harvested sugar cane and associated leaves and other lighter materials are accumulated in a hopper. The hopper includes a conveyor belt mechanism which transfers the material to a rotating paddle wheel. The rotating paddle wheel carries the composite material from the hopper and throws it downwardly in a stream of falling material. A blower mechanism provides a transverse air flow to the falling materials which deflects the lighter leaves and other materials from the heavier sugar cane and produces a separation of the cane material from the remainder of the mixture. The heavier cane material falls downwardly for collection in one area of the separator while the lighter deflected materials are accumulated elsewhere.

While the foregoing described air separating devices have achieved some success in the particular uses for which they have been conceived, they are mass production devices which do not readily lend themselves to the convenient processing of small quantities of bird seed mixture. There arises and remains, therefore, a need in the art for a small compact portable and inexpensive hull separator which may be maintained and used by individual bird owners.

SUMMARY OF THE INVENTION

Accordingly, it is a general object of the present invention to provide an improved hull separator. It is a more particular object of the present invention to provide an improved hull separator which is portable and convenient for use by individual bird owners. It is a still more particular object of the present invention to provide a portable hull separator which is suitable for use in a close dwelling environment and which may be operated on portable battery power.

In accordance with the invention, there is provided a separator having an enclosed housing defining an internal air separation passage and a battery powered electric fan producing an air flow through the internal passage. The housing further defines an interior hopper for accumulating a quantity of to-be-separated seed material. The hopper in turn defines a discharge gate having adjustable means for regulating the flow rate of seed material from the hopper into the air flow chamber. Baffle means within the housing provide separate collection of the seed material and hull material in a pair of internal collecting reservoirs. Filter means are provided to clean the air flow following separation and prior to discharge from the housing.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 is a perspective view of a portable hull separator constructed in accordance with the present invention; and FIG. 2 is a section view of the present invention portable hull separator taken along section lines 2—2 in FIG. 1.

DESCRIPTION OF THE PREFERRED EMBODIMENT

FIG. 1 sets forth a perspective view of the present invention portable hull separator generally referenced by numeral 10 which includes a housing 11 preferably fabricated of a molded plastic material in accordance with conventional fabrication techniques. Housing 11 includes a front surface 12, a pair of side surfaces 13 and 15, a bottom surface 14, a rear surface 16 and a top surface 17. Front surface 12 further defines a pair of rectangular apertures 20 and 21. A movable drawer 22 is supported within aperture 20 while a similar movable drawer 23 is supported within aperture 21. Drawers 22 and 23 are slideably movable within hull separator 10 and are removable through apertures 20 and 21 for reasons set forth below in greater detail. Side 13 defines a plurality of laterally extending louvers 34 which provide for air flow between the interior of housing 11 and the exterior thereof. Top 17 supports a pair of control switches 32 and 33, the purpose of which is set forth below in greater detail. A power cord 35, constructed in accordance with conventional electrical power cord fabrication techniques, should be understood to include a conventional electric plug at one end and extends through housing 11 via an aperture 37 (better seen in FIG. 2) to the interior of hull separator 10. A conventional grommet 36 supports power cord 35 within aperture 37. A seed bin cover 30 is pivotally secured to top 17 by a laterally extending hinge 31. For reasons set forth below in greater detail, seed bin cover 30 is pivotally movable about hinge 31 between the closed position shown in solid line representation in FIG. 1 and the open position shown in dashed line representation. Seed bin cover 30 is pivoted about hinge 31 from the closed position to the open position in a pivotal motion indicated by arrow 44. A plurality of supportive generally cylindrical feet 40, 41, 42 and 43 (the latter not shown) support housing 11 for convenient placement upon a flat surface such as a table or countertop.

In operation, by means set forth below in greater detail, a quantity of bird seed or the like is placed within housing 11 by rotating seed bin cover 30 to its open position and pouring the seed material into a seed bin (seen in FIG. 2) within housing 11. Thereafter, seed bin cover 30 is closed and switches 32 and 33 are operated to apply power to an internal electric motor driven fan (seen in FIG. 2) which causes an air flow through housing 11 and out through louvers 34. By means also described in greater detail below, the flow of air through housing 11 produces a separation of the lighter hull materials and other lighter impurities from the seed mixture within the seed bin such that a quantity of such hull materials and other extraneous materials are collected within drawer 22 while the heavier seed materials are collected within drawer 23. Following the completion of the hull separating process, drawer 22 may be removed to discard the unwanted hull materials and replaced within aperture 20 of housing 11. Similarly, drawer 23 may be removed through aperture 21 of housing 11 and the seed materials therein, which are now substantially free from undesired hull segments and the like, may be conveniently stored in order that drawer 33 may be placed back within housing 11 to continue the hull separation operation. It will be apparent to those skilled in the art that the present invention portable hull separator is self-contained with the exception of power cord 35 and is, as a result, readily maintained in the average kitchen or utility room environment. It will be further apparent to those skilled in the art that the present invention portable hull separator may be fabricated in different sizes to suit the volume of seed desired to be processed in a given cycle. In addition, while in the preferred embodiment standard electrical power available from a conventional outlet is utilized to power the air drive mechanism within the hull separator, it will be apparent to those skilled in the art that a portable source of electrical power such as batteries may be supported within housing 11 and utilized to drive the electric drive motor therein. In such case, the need for power cord 35 is eliminated and an increased degree of convenience and portability is achieved by the present invention hull separator.

FIG. 2 sets forth a section view of the present invention portable hull separator taken along section lines 2—2 in FIG. 1. Housing 11 defines a side surface 15, a bottom surface 14, a side surface 13 and a top surface 17. It should be understood that, as described above, housing 11 further includes a front surface 12 and a rear surface 16. A seed bin 60 is formed and supported within housing 11 and includes a tapered rear wall 64, a side wall 62 and a front wall 63 which cooperate with the interior of back surface 16 to form a funnel-shaped seed bin. Front wall 63 extends downwardly from seed bin 60 and defines an aperture 51. Side 15 defines an aperture 50 generally in alignment with aperture 51. Side 15 further defines an aperture 52 while front wall 63 further defines an aperture 71. A threaded support 91 is pivotally secured to side 15 within aperture 52. An adjustment shaft 92 having an external thread is threadably received within support 91 and extends through aperture 71. Shaft 92 supports a knob 97 on its outer end and is threadably received within a threaded coupling 93 at its other end.

An air flow chamber 80 is supported within the center portion of housing 11 and defines a generally rectangular closed structure having an aperture 90 at one end and an aperture 83 at the other end. A bottom aperture 98 is formed in the bottom surface of air flow chamber 80. A gate 95 having a generally planar configuration is pivotally secured to a hinge 96 within air flow chamber 80 at one end and is pivotally secured to threaded coupling 93 at the other. A generally planar gate 94 is pivotally coupled at one end to threaded coupling 93 and gate 95 via a hinge 108. The other end of gate 94 extends downwardly through opening 98 of air flow chamber 80. A filter 81 is supported within air flow chamber 80 and extends continuously from the interior of back surface 16 to the interior of front surface 12 (not shown). A second filter 82 is supported within air flow chamber 80 overlying aperture 83.

Front wall 63 is spaced from air flow chamber 80 to produce an air passage 70 therebetween. Air passage 70 extends downwardly beneath air flow chamber 80 and terminates in a discharge passage 72. A movable drawer 23 is supported within housing 11 beneath discharge passage 72. A quantity of seed and hull mixture 61 is supported within seed bin 60 above air passage 70. A seed bin cover 30 is coupled to top 17 by a hinge 31 and, in the closed position shown, overlies the upper portion of seed bin 60.

A generally planar gate 100 is coupled to air flow chamber 80 by a hinge 101 and extends generally downward therefrom. A motor support chamber 110 extends between the interior of front surface 12 and back surface 16 and supports an electric fan motor 111. Motor support 110 further defines a plurality of downwardly extending vent apertures 127, a plurality of rearwardly extending vent apertures 126 and a plurality of upwardly extending apertures 128. A shaft 113 extends from motor 111 and in accordance with conventional fabrication techniques should be understood to be coupled to the rotatable member of motor 111 (not shown). A multi-bladed fan 112 is secured to shaft 113. A pulley 114 is secured to shaft 113 between fan 112 and motor 111. A support wall 129 and a support wall 132 extend downwardly from motor support 110 and further support motor 111 within housing 11.

A multiple element pulley assembly 120 includes a plurality of concentrically supported pulleys 121, 122, 123 and 124 arranged in order of descending diameter sizes respectively. A pulley 115 is supported above pulley 114, in a right angle relationship to pulley 114 and in a parallel relationship to pulley assembly 120. A flexible belt 116 extends about pulley 114, pulley 115, and a selected one of pulleys 121, 122 or 123. In accordance with conventional fabrication techniques, pulley 115 is movably supported by means not shown which provide a takeup adjustment for belt 116. Accordingly, and in further accordance with conventional fabrication techniques, the relative coupling ratio between pulley 114 and pulley assembly 120 is determined by selecting the particular one of pulleys 121, 122 and 123 about which belt 116 is reened.

A paddle wheel 131 is rotatably supported between side wall 62 and back surface 16 within seed bin 60. A pulley 130 is coupled to paddle wheel 131 such that rotation of pulley 130 causes a corresponding rotation of paddle wheel 131 within seed bin 60. A flexible drive belt 125 extends about pulley 130, through slot 65 and about pulley 124 of pulley assembly 120.

An electrical power cord 35 which supports a pair of insulated wires 105 and 109 extends through aperture 37 in side surface 13 and is supported by a grommet 36. Insulated wire 105 is coupled to one input of on/off switch 32 while insulated wire 109 is coupled directly to motor 111. An insulated wire 104 is coupled between the remaining terminal of on/off switch 32 and motor 111. A pair of insulated wires 106 and 107 are coupled to switch 33 and to appropriate terminals within motor 111 (not shown) such that switch 33 provides a speed control for motor 111. A microswitch 118 is supported on top 17 and is coupled to to switch 32 by wires 117 and 119. Microswitch 118 interrupts operation when cover 30 is raised. It will be apparent to those skilled in the art that any number of combinations of motor 111 and switches 32 and 33 may, in accordance with conventional fabrication techniques, be utilized to provide the on/off function of switch 32 and the motor speed control function of switch 33.

In operation, a quantity of seed and hull mixtures 61 is placed within seed bin 60 by opening seed bin cover 30 and depositing it therein. By actuation of switches 32 and 33, motor 111 is operative at the desired speed and causes a rotation of shaft 113 which in turn rotates fan 112 and pulley 114. The rotation of pulley 114 causes a corresponding rotation of pulley assembly 120 due to the coupling of belt 16 therebetween. With the rotation of pulley assembly 120, the coupling of belt 125 from pulley 124 of pulley assembly 120 to pulley 130 causes a corresponding rotation of pulley 130 and thereby paddle wheel 131. The rotation of paddle wheel 131 causes a predetermined flow of seed and hull mixture 61 to descend downwardly into passage 70.

Concurrently, the rotation of fan 112 causes a flow of air to be drawn from air flow chamber 80 as indicated by arrows 84. This air flow passes through filters 81 and 82 and through aperture 83. Thereafter, the air flow is drawn past fan 112 and passes out from housing 11 via apertures 128, 126, 127 and louvers 34. The air flow path is indicated by arrows 84 through filters 81 and 82 past fan 112. Thereafter, a portion of the air flow indicated by arrow 87 passes outwardly from motor support 110 through apertures 127 as indicated by arrows 88, apertures 126 as indicated by arrows 85 and apertures 128 as indicated by arrow 79. In addition, a portion of the air flow passing through aperture 83 flows directly about motor 111 and outwardly through louvers 34 as indicated by arrows 85. The air flow drawn from air flow chamber 80 by the action of fan 112 in turn causes air to be drawn inwardly through apertures 50 and 51 in side 15 and front wall 63 respectively. Thereafter, the air flow is drawn through aperture 90 into air flow chamber 80. As a result, a cross flow of air is created through passage 70 in the direction indicated by arrow 89. As the rotation of paddle wheel 130 is carried forward, a measured flow of falling seed and hull mixture 66 descends through passage 70 and is subjected to the transverse air flow passing through passage 70 in the direction indicated by arrow 89.

The transverse flow of air through passage 70 carries the lighter hull segments and other lighter debris along with it into air flow chamber 80 to form a stream of hull materials 102. The heavier seed material within fallen mixture 66 is less affected by the transverse air flow and descends downwardly through passage 70 and out through discharge passage 72 to be collected within drawer 23. Conversely, the lighter hull materials 102 continue into air flow chamber 80 and are temporarily collected there. Thereafter, if either power switch 32 is turned off or cover 30 is raised operating microswitch 118, the hulls fall across the surface of gate 94 to eventually descend past gate 100 to accumulate within drawer 22.

In accordance with an important aspect of the present invention, the characteristic of hull separation of the present invention system may be adjusted by turning knob 97 in accordance with the following. The rotation of knob 97 in the clockwise direction causes threaded adjustment shaft 92 to be advanced inwardly with respect to threaded support 91. The inward motion of shaft 92 causes a pivotal motion of gate 95 about hinge 96 in the direction indicated by arrow 127. The inward motion of threaded shaft 92 and the pivotal motion of gate 95 cause a corresponding pivotal motion of gate 94. With gate 95 pivoted downwardly in the direction indicated by arrow 127, gates 94 and 95 are moved to the lower positions shown in dashed line representation. Accordingly, and in accordance with an important aspect of the present invention, the adjustment of gates 94 and 95 toward the dashed line positions shown, provides a higher degree of separation between the hull segments and the seed material. Conversely, the counterclockwise rotation of knob 97 causes shaft 92 to be drawn outwardly through threaded coupler 91 which rotates gate 95 in the direction indicated by arrow 126 which causes a corresponding motion of gate 94 such that a reduced separation characteristic is produced by the air flow through passage 70 and air flow chamber 80.

Thus, in accordance with an important aspect of the present invention, the separation characteristics of the present invention hull separator are easily and conveniently adjusted by turning knob 97 and adjustment shaft 92. The use of movable gates 94 and 95 within air flow chamber 80 permits the separation characteristics of the present invention hull separator to be easily and conveniently controlled in response to the type of seed and hull material being processed.

What has been shown is a lightweight, portable, easy to use hull separator which provides adjustable separation techniques and which is configured to conveniently collect seed material and separated hull segments and other debris within the seed mixture. The device shown includes a flexible gate assembly which permits the separation characteristics of the hull separator to be conveniently adjusted.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. For use in separating hull segments from a mixture of seed and hull segments, a portable hull separator comprising:

a housing defining an internal cavity having a seed bin for supporting a quantity of the mixture, a downwardly extending mixture passage having an upper end coupled to said seed bin and a lower end forming a discharge passage and an airflow chamber, said airflow chamber being coupled to said mixture passage between said upper and lower ends thereof;

an electric motor;

moving means including a rotatable member coupled to and driven by said electric motor supported within said seed bin for creating a disbursed flow of the mixture downwardly from said seed bin through said mixture passage;

seed collection means supported within said housing below said discharge passage;

hull collection means supported within said housing below said airflow chamber;

fan means including a rotatable fan operationally coupled to said electric motor supported within said internal cavity of said housing and coupled to said airflow chamber for causing an airflow from the exterior of said housing, through said mixture passage generally transverse to the flow of the mixture, through said airflow chamber and back to the exterior of said housing such that said hull segments within the mixture tend to be drawn from said mixture passage into said airflow chamber while said seed in the mixture tends to fall downwardly through said mixture passage and said discharge passage into said seed collection means;

adjustable gate means supported within said airflow chamber for controlling the degree of separation of said hull segments from said seed occurring within said mixture passage and directing said hull segments toward said hull collection means;

adjustment means coupled to said adjustable gate means for adjusting said adjustable gate means; and filter means for filtering said airflow prior to its return to the exterior of said housing.

2. A portable hull separator as set forth in claim 1 wherein said airflow chamber defines an elongated closed chamber having an input aperture coupled to said air passage, an output aperture coupled to said fan, and a discharge aperture and wherein said adjustable gate means include:

a first planar member having a first edge hingedly secured within said airflow chamber and a second edge; and a second planar member having a first edge hingedly attached to said second end of said first planar member and a second edge extending outwardly from said airflow chamber through said discharge aperture.

3. A portable hull separator as set forth in claim 2 wherein said adjustment means include:

a threaded shaft extending through said housing and having an outer end defining a knob and an inner end;

a first coupling secured to said first and second planar members receiving said threaded shaft; and a threaded support coupled to said housing and receiving said threaded shaft.

4. A portable hull separator as set forth in claim 3 wherein said filter means include a first filter overlying said output aperture of said airflow chamber.

5. A portable hull separator as set forth in claim 4 wherein said filter means include a second filter extending across said airflow chamber.

6. A portable hull separator as set forth in claim 5 wherein said rotatable member of said moving means is a paddle wheel.

7. A portable hull separtor as set forth in claim 6 wherein said housing defines a pair of drawer apertures and wherein said seed collection means and said hull collection means are each removable drawers disposed within said housing and removable through said drawer apertures.

* * * * *